United States Patent [19]

Holt

[11] 4,280,253

[45] Jul. 28, 1981

[54] METHOD FOR COLLECTING FIBROUS MATERIAL

[75] Inventor: Dennis S. Holt, Granville, Ohio

[73] Assignee: Owens-Corning Fiberglas Corporation, Toledo, Ohio

[21] Appl. No.: 21,054

[22] Filed: Mar. 16, 1979

[51] Int. Cl.[3] ..... D04H 5/08

[52] U.S. Cl. ..... 19/296; 19/301; 19/161.1

[58] Field of Search ..... 28/106, 103; 19/161.1, 19/296, 299, 300, 301, 302, 303, 304

[56] References Cited

U.S. PATENT DOCUMENTS

| | | | |
|---|---|---|---|
| 2,912,723 | 11/1959 | Roberts | 19/304 X |
| 3,034,180 | 5/1962 | Greiner et al. | 19/301 |
| 3,038,215 | 6/1962 | Harwood | 28/106 |
| 3,132,383 | 5/1964 | Papps | 19/161.1 X |
| 3,474,500 | 10/1969 | Olson et al. | 19/296 X |
| 3,474,502 | 10/1969 | Pohland | 19/161.1 |

FOREIGN PATENT DOCUMENTS

| | | | |
|---|---|---|---|
| 1228793 | 4/1971 | United Kingdom | 19/296 |
| 331125 | 4/1972 | U.S.S.R. | 19/296 |

*Primary Examiner*—Louis Rimrodt

*Attorney, Agent, or Firm*—Ronald C. Hudgens; Philip R. Cloutier; Ted C. Gillespie

[57] ABSTRACT

A method and apparatus for collecting fibrous material (14) comprises distributing the fibrous material (14) onto a collection surface (18) to form a pack (20), and intercepting a portion of the fibrous material (14) during formation of the pack (20) with a plurality of spikes (24) extending from the collection surface (18). The spikes (24) partially penetrate the pack (20) and retain the intercepted fibrous material (14) in the upper portion (27) of the insulation pack (20).

2 Claims, 4 Drawing Figures

METHOD FOR COLLECTING FIBROUS MATERIAL

TECHNICAL FIELD

This invention relates to the collecting of fibrous material. In one of its more specific aspects, this invention relates to the distributing of fibrous mineral material to form an insulation pack. In one of its most specific aspects, this invention relates to the formation of insulation packs of glass fibers and in particular, light density insulation packs suitable for use as building insulation.

BACKGROUND OF THE INVENTION

A common method of collecting fibrous material, particularly fibrous mineral material, involves distributing the fibrous material onto a collecting surface to form an insulation pack. The fibers can be collected as a pack on an endless belt positioned beneath the fiber distributing apparatus, and the pack can be built up continuously on the moving belt. Such fiber collection apparatus can be combined with an exhaust fan positioned to draw gases through the belt and thereby force the fibrous material toward the belt to form the pack. Apparatus for forming packs, such as insulation packs as thick as 3 inches or more, can use a series of fiber distributing means. The exhaust fans associated with such apparatus for producing relatively thick insulation packs can have an extremely strong suction effect on the fibrous material, since the manufacture of thicker insulation packs generally requires stronger suction fans.

A common problem with such apparatus is that the fan pulls the initially deposited fibers onto the belt so that the bottom layer of the insulation pack is denser than the upper portions. It is believed that the greater the final thickness of the insulation pack, the greater is the density variation from the bottom to the top of the pack. The fact that the bottom portion of the insulation pack is of greater density than the upper portion of the pack is undesirable in that the greater density portion does not compensate for the increased material usage by providing an equivalent increased thermal insulative value.

SUMMARY OF THE INVENTION

According to this invention, there is provided a method and apparatus for collecting fibrous material into a pack in which a portion of the fibers, otherwise occupying the lower portion of the pack, is retained in the upper portion of the pack.

Also according to this invention, there is provided a method comprising distributing fibrous material onto a surface to form a pack, and intercepting a portion of the fibrous material during formation of the pack with a plurality of elongate members which extend from the surface to retain the intercepted portion of the fibrous material in the upper portion of the pack.

In one of its specific embodiments a gas is drawn through the pack and the surface.

In its preferred embodiment the intercepted portion of the fibrous material is intercepted at a distance from the bottom of the pack within the range of from about 10 percent to about 60 percent of the thickness of the pack.

According to this invention, there is also provided apparatus comprising a surface for receiving fibrous material to form a pack, means for forcing a gas through the pack and the surface, and a plurality of elongate members extending from the surface into the pack, the elongate members being adapted to intercept a portion of the fibrous mineral material and thereby retain the intercepted portion of the fibrous material in the upper portion of the pack.

In a preferred embodiment the elongate members are adapted to penetrate the pack a distance within the range of from about 10 percent to about 60 percent of the thickness of the pack.

According to this invention, there is also provided apparatus comprising a surface for receiving fibrous material, means for distributing the fibrous material onto the surface to form a pack thereon, and a plurality of elongate members extending from the surface, the elongate members being of length sufficient to penetrate only through a portion of the pack.

In a specific embodiment of the invention the elongate members are adapted to intercept a portion of the fibrous material to prevent the portion of material from being distributed in the bottom portion of the pack.

In a preferred embodiment the elongate members are adapted to penetrate the pack a distance within the range of from about 10 percent to about 60 percent of the thickness of the pack.

In another preferred embodiment the elongate members have end surfaces having oblong configurations.

In one of its specific embodiments, this invention employs a collection surface comprising a foraminous first belt and a second belt on which are mounted the elongate members, the second belt being adapted for travel in such close proximity to the first belt that the elongate members extend through the first belt.

DESCRIPTION OF THE INVENTION

Figures 1, 2, 3:
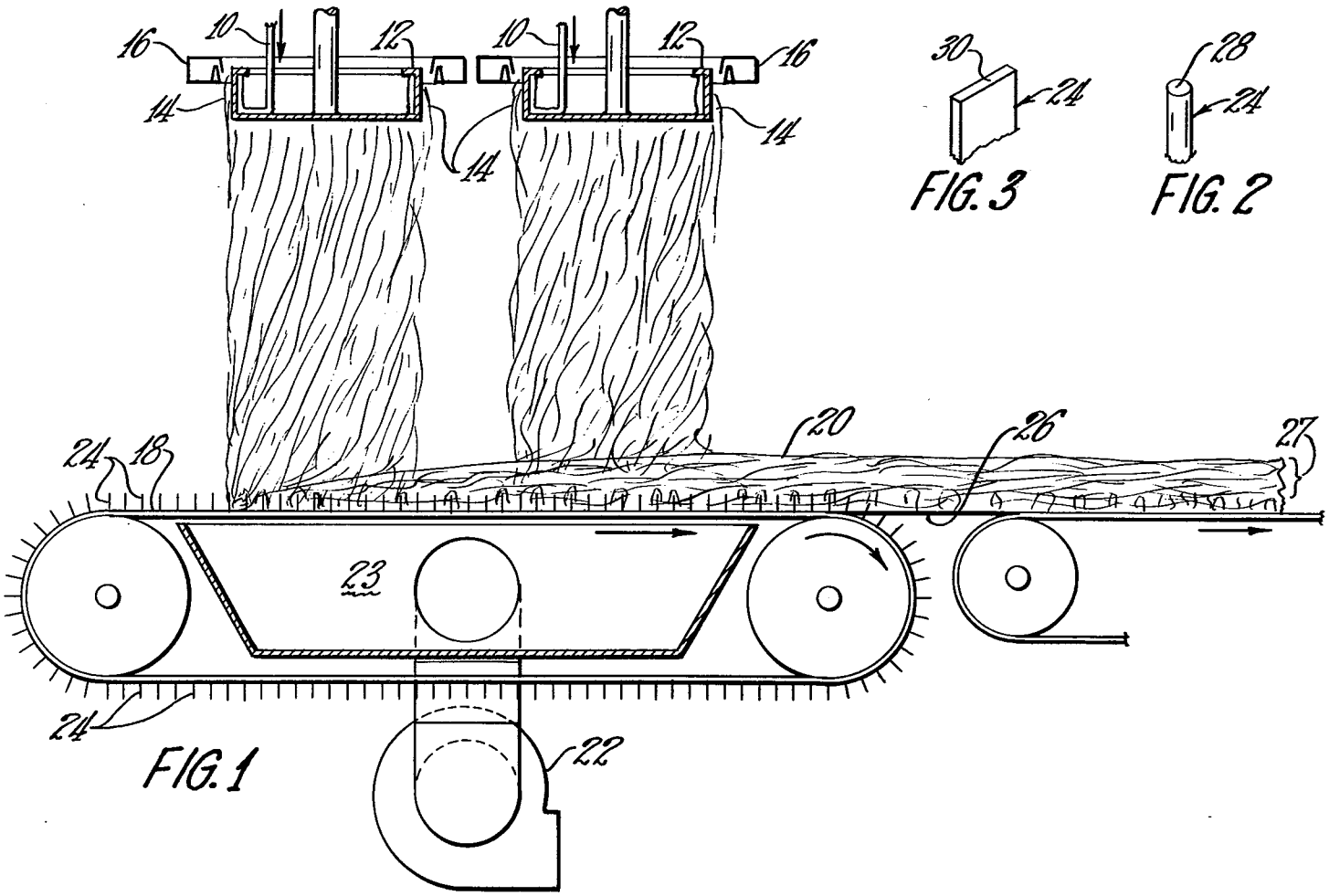
FIG. 1 is a cross-sectional view in elevation of the apparatus for collecting the fibrous material according to the principles of this invention.
FIGS. 2 and 3 are detailed views of a few of the elongate members suitable for this invention.

FIG. 1 depicts one embodiment of the invention in which fibrous material 14 is distributed onto collection surface 18 to form insulation pack 20. The fibrous material can be supplied from any suitable source, but preferably from spinners 12 which are supplied by streams 10 of molten mineral material, preferably molten glass. The fibers emanating from the spinners can be turned downward and can be further attenuated by blowers 16 in order to distribute the fibers onto the collection surface to form the insulation pack. The collection surface can be of any suitable type, preferably an endless belt or conveyor, and can be driven by any suitable means. The collection surface is preferably foraminous to enable the gases to be drawn through the pack and through the collection surface. Fan 22 can be adapted to draw air, or other gases, through the insulation pack and through the collection surface via suction box 23 which can be positioned beneath the collection surface. Alernatively, a plurality of fans and/or suction boxes could be employed to create different degrees of suction through different portions of the collection surface. The suction of the fan urges the fibers toward the collection surface.

As shown in FIG. 1, a plurality of elongate members or spikes 24 extends from the surface and penetrates the pack being formed on the collection surface. As the pack travels away from the fiber distribution zone, the spikes are withdrawn from the insulation pack. The spikes intercept a portion of the glass fibers being distributed onto the collection surface and retain that portion of fibers in the upper portion 27 of the pack. The effect of retaining the intercepted portion of the fibers is a reduction of the density of bottom portion 26 of the pack.

It is to be understood that spikes of numerous sizes, lengths, shapes, number and end surfaces could be utilized for the purposes of this invention. The spikes will preferably be uniformly positioned on the collection surface. The greater the reduction in density desired in the bottom portion of the pack, the more closely should be the positioning of the spikes.

In the preferred embodiment of this invention, the spikes will extend into the pack a distance within the range of from about 10 percent to about 60 percent of the thickness of the pack. In the most preferred embodiment, the spikes will extend a distance within the range of from about 25 percent to about 35 percent of the thickness of the pack. The spikes may be of unlike lengths in order to provide the most advantageous interception of fibers to create a pack having any desirable density distribution.

The elongate members can have any suitable configuration for intercepting the fibers. As shown in FIG. 2, the end surface 28 of the elongate member can be circular and flat. As shown in FIG. 3, another embodiment of the elongate member has a tip or end surface 30 having an oblong configuration in order to create a larger area for intercepting the glass fibers.

Figure 4:
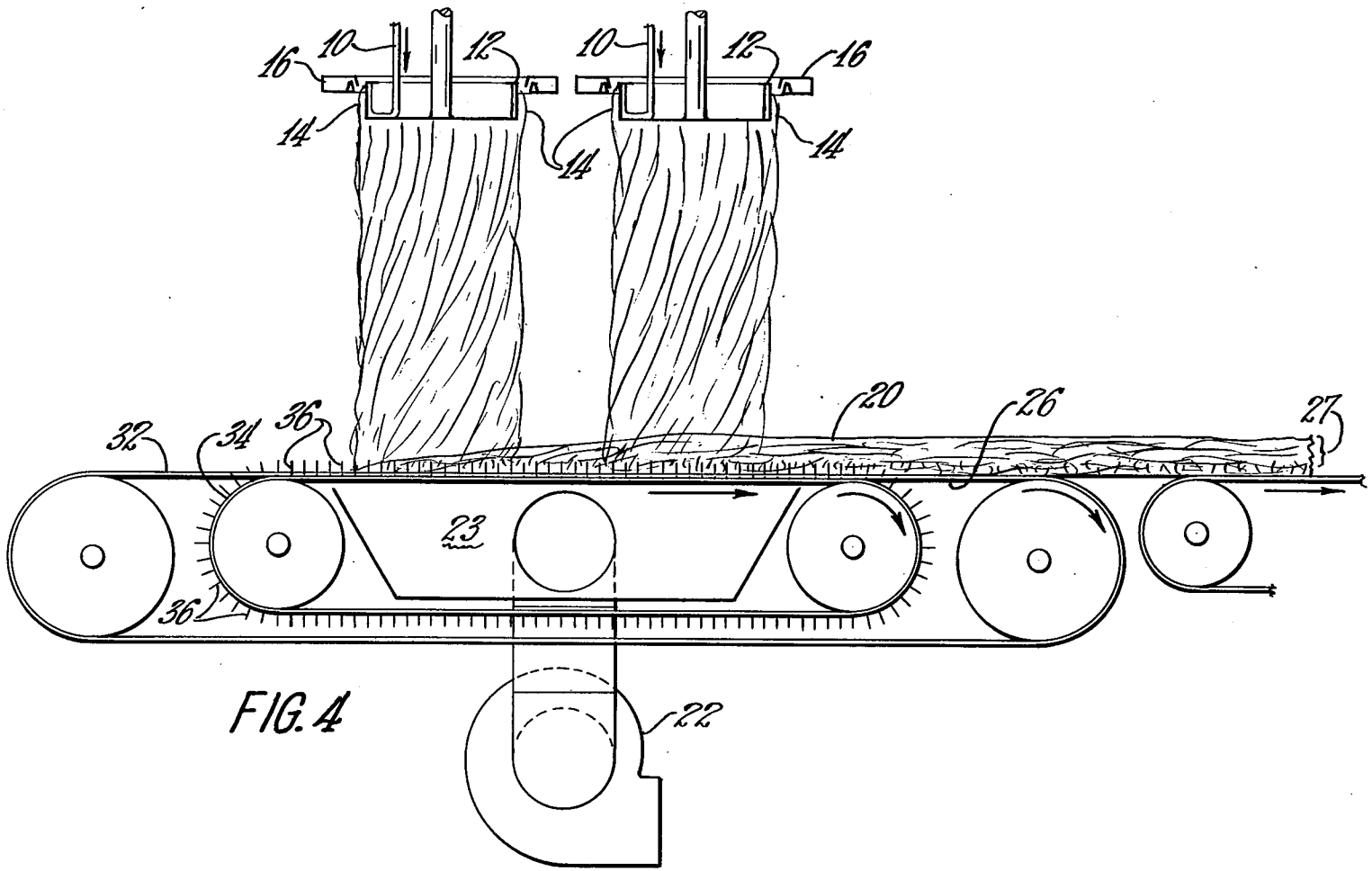
FIG. 4 is a cross-sectional view in elevation of an additional embodiment of the invention.

Referring to FIG. 4, in another embodiment of the invention collection surface 32 will be a foraminous belt upon which the fibers are deposited. Mounted for travel beneath the collection surface is inner belt 34 upon which are mounted elongate members, or spikes, 36. The inner belt can be mounted for travel directly beneath the collection surface and in such close proximity to the collection surface that the spikes extend through the foraminous collection surface and penetrate into the pack. As can be seen, at the downstream end of the inner belt, the spikes will be withdrawn from the foraminous collection surface.

It can be appreciated, in view of the above, that various modifications can be made to this invention. All such variations are intended to be encompassed, however, by the claims herein.

I claim:

1. In a method for producing an insulation pack of fibrous mineral material of the type in which mineral fibers are formed from a plurality of spinners, the mineral fibers are directed downwardly onto a foraminous collection surface to form the insulation pack thereon, gases are drawn downwardly through said foraminous collection surface and the insulation pack to urge the mineral fibers toward said foraminous collection surface, wherein the improvement comprises: intercepting a portion of the mineral fibers during formation of the insulation pack with a plurality of elongate members which extend from said foraminous collection surface to prevent said portion of fibrous material from being drawn by the downwardly flowing gases into the lower portion of the insulation pack.

2. The method of claim 1 comprising intercepting said portion of the fibrous material at a distance from the bottom of said pack within the range of from about 10 percent to about 60 percent of the thickness of said pack.

* * * * *